US012672715B1

(12) United States Patent
Lorch et al.

(10) Patent No.: US 12,672,715 B1
(45) Date of Patent: Jul. 7, 2026

(54) MODULAR TRANSFORMING TROLLEY WITH ADJUSTABLE AXLE MECHANISM FOR OFFICE USE

(71) Applicants: Kim David Lorch, Las Vegas, NV (US); Diana Taylor Malotte, Las Vegas, NV (US)

(72) Inventors: Kim David Lorch, Las Vegas, NV (US); Diana Taylor Malotte, Las Vegas, NV (US)

( * ) Notice: Subject to any disclaimer, the term of this patent is extended or adjusted under 35 U.S.C. 154(b) by 43 days.

(21) Appl. No.: 19/220,611

(22) Filed: May 28, 2025

Related U.S. Application Data

(62) Division of application No. 19/011,825, filed on Jan. 7, 2025, now Pat. No. 12,396,552.

(51) Int. Cl.

| | |
|---|---|
| ***A47B 21/04*** | (2006.01) |
| ***A47B 21/02*** | (2006.01) |
| ***A47B 21/03*** | (2006.01) |
| ***A47B 21/06*** | (2006.01) |

(52) U.S. Cl.
CPC ..... *A47B 21/04* (2013.01); *A47B 21/02* (2013.01); *A47B 21/0314* (2013.01); *A47B 21/06* (2013.01); *A47B 2021/066* (2013.01); *A47B 2200/006* (2013.01)

(58) Field of Classification Search
CPC ..... A47B 21/04; A47B 21/06; A47B 21/02; A47B 21/0314; A47B 2021/06; A47B 2200/006
USPC ..... 280/35
See application file for complete search history.

(56) References Cited

U.S. PATENT DOCUMENTS

| | | | | |
|---|---|---|---|---|
| 429,557 | A | 6/1890 | Meyer | |
| 5,630,566 | A | 5/1997 | Case | |
| 6,206,285 | B1 | 3/2001 | Baitz et al. | |
| 6,435,109 | B1 | 8/2002 | Dell et al. | |
| 9,743,754 | B2 * | 8/2017 | Ergun | A47B 9/12 |
| 10,004,327 | B2 | 6/2018 | McRorie, III | |

(Continued)

OTHER PUBLICATIONS

Global Industrial™. Mobile Standing Computer Workstation, Gray. Published by Global Equipment Company Inc., 2024. New York, United States. https://www.globalindustrial.com/p/mobile-standing-point-of-care-medical-workstation-computer-pc-cart-height-adjustable-pneumatic.

(Continued)

*Primary Examiner* — Hau V Phan
(74) *Attorney, Agent, or Firm* — Carson Patents; Gregory D Carson

(57) ABSTRACT

The present invention relates to a versatile, adjustable, non-rotating axle device engineered to enhance flexibility and ergonomic comfort in diverse work and living environments. This device supports various platform surfaces, enabling smooth, secure vertical adjustments to accommodate different user postures—from seated to standing or any intermediate position. It incorporates a choice of gas-spring or electric lift mechanisms for precise, controlled movement, along with integrated safety stops and vibration-damping features to ensure stability and user safety. An optional digital memory interface allows for personalized ergonomic settings, facilitating quick and repeatable height adjustments. Designed to function without reliance on specialized mounting arms, the axle device offers a universal solution for adaptable, ergonomically optimized setups across a broad spectrum of applications.

11 Claims, 4 Drawing Sheets

(56) References Cited

U.S. PATENT DOCUMENTS

| | | | | |
|---|---|---|---|---|
| 10,813,450 | B2 * | 10/2020 | Albers | A47B 9/20 |
| 11,198,363 | B1 | 12/2021 | Jinnah | |
| 11,318,367 | B2 * | 5/2022 | Mercer | A63F 1/067 |
| 11,547,207 | B2 * | 1/2023 | Albers | A47B 9/12 |
| 11,672,334 | B2 * | 6/2023 | Hazzard | A47B 21/0073 248/226.11 |
| 11,994,255 | B2 | 5/2024 | Barros et al. | |
| 12,022,941 | B2 * | 7/2024 | Hazzard | F16M 11/04 |
| 12,396,552 | B1 * | 8/2025 | Lorch | A47B 9/20 |
| 2012/0217710 | A1 * | 8/2012 | Houlihan | B62B 3/10 280/35 |
| 2013/0126682 | A1 * | 5/2013 | Tholkes | F16M 11/04 29/428 |
| 2016/0302571 | A1 | 10/2016 | McBride et al. | |
| 2017/0013957 | A1 * | 1/2017 | McRorie, III | F16M 11/24 |
| 2021/0318724 | A1 | 10/2021 | Sung et al. | |

OTHER PUBLICATIONS

Mount-It !. Rolling Computer Work Station with Monitor Mount. Published by Mount-It!, 2024. California, United States. https://mount-it.com/products/mount-it-computer-mobile-monitor-cart-with-cpu-holder-mi-7948.

Scale 1:1. Sidekick—Scale 1:1. Designed by David Winston. Published by Scale 1:1, 2024. Los Angeles, United States. https://scale1to1.com/.

Top Best 10 Reviews. Top 10 Best Computer Carts in 2024 | Portable Desk. Published by TopBest10Reviews.com, 2024. Location unspecified. https://www.topbest10reviews.com/best-computer-carts/.

Wayfair LLC. Inbox Zero Filadelfo 45.5" H x 21.5" W 1 Laptop Cart with Wheels. Wayfair, 2024. Boston, United States. https://www.wayfair.com/organization-storage/pdp/inbox-zero-filadelfo-adjustable-laptop-cart-w008008998.html.

* cited by examiner

MODULAR TRANSFORMING TROLLEY WITH ADJUSTABLE AXLE MECHANISM FOR OFFICE USE

CROSS-REFERENCE TO RELATED APPLICATIONS

This application is a divisional of U.S. patent application Ser. No. 19/001,825, filed on 7 Jan. 2025, entitled Modular Transforming Trolley with Adjustable Axle Mechanism for Office Use.

BACKGROUND OF THE INVENTION

Technical Field

This invention relates generally to a modular transforming trolley. This invention relates more particularly to an apparatus/device for home office use, designed to enhance mobility, ergonomics, and functionality for remote or flexible work environments.

This invention relates generally to apparatuses and devices for creating adaptable workstations with integrated power management and storage solutions. This method also can be used with various home and office setups, supporting both seated and standing work configurations. This invention relates more particularly to a trolley designed to optimize workspace flexibility and user comfort.

This invention pertains to the field of workstation apparatuses and mobile work surfaces, which encompass adjustable or convertible furniture, including desks, tables, and other apparatuses that provide ergonomic and functional support for office equipment and work-related activities. Specifically, this invention relates to modular trolleys designed for home office and remote work environments, featuring mobility, adjustable work surfaces, integrated power management systems, and storage compartments.

Background Art

Workstation apparatuses, particularly those designed for office and remote work environments, have been the subject of various innovations. Known prior art includes mobile workstations with height-adjustable features, storage compartments, and integrated power management systems. These designs are often tailored to specific industries, such as medical, manufacturing, or industrial environments, where mobility, durability, and specialized equipment accommodation are prioritized.

For example, there is a mobile workstation with adjustable height columns and integrated power solutions. However, this design focuses on industrial applications and lacks the flexibility and aesthetic appeal needed for home office environments. Similarly, there is a mobile computer workstation with adjustable features but is geared toward medical and commercial settings, limiting its applicability to modern home office users. Other prior art, such as the Global Industrial™ Mobile Standing Workstation, emphasizes ergonomic adjustments like pneumatic height control, but its design is primarily focused on heavy-duty use in professional environments, rather than the lightweight, flexible needs of home offices.

Despite these advancements, there remains a gap in the market for a modular transforming trolley specifically designed for home office use. Prior art workstations are often too specialized, bulky, or industrial in appearance, which makes them less suitable for the remote or flexible work environments that have become increasingly common. Additionally, while some prior art includes ergonomic adjustments, the range of customization needed to accommodate both sitting and standing work, as well as integrated power management, is often lacking or limited.

In light of the foregoing prior art, there is a need for a modular transforming trolley to better address the ergonomic, functional, and aesthetic needs of modern home office environments. The proposed trolley not only provides advanced height adjustability and tilt-able work surfaces, but also integrates essential features such as power outlets, USB ports, wireless charging, and customizable storage compartments. These enhancements allow users to create a fully adaptable and comfortable workspace, tailored to the demands of remote work, all while maintaining a sleek and minimalistic design that fits seamlessly into a home office setting.

The proposed invention solves several problems associated with prior art workstations by focusing on versatility, mobility, and ergonomic comfort specifically for home office users. It addresses the need for a modular design that can be reconfigured easily, incorporates advanced power management solutions, and includes safety features such as retractable stabilizers and braking systems. Moreover, the use of eco-friendly materials and attention to modern design aesthetics distinguish the proposed trolley from more industrial or specialized products found in the prior art.

BRIEF SUMMARY OF THE INVENTION

The present invention relates to a transforming modular trolley and an adjustable axle device designed for versatile office use, enabling seamless transitions between seated and standing work positions while providing organized storage and integrated power management solutions. The inventive concept addresses the need for a multifunctional, ergonomic workstation that optimizes space usage, enhances user comfort, and supports efficient cable and device management in both home and professional office environments.

The transforming modular trolley features a robust base equipped with non-marring casters for easy mobility across various floor surfaces. The modular top assembly comprises a primary work surface, dedicated surfaces for holding a pad or phone at an ergonomic angle, recessed areas for personal items such as cups and small office accessories, and a separate surface for a computer mouse. The primary work surface is equipped with a tilt-able mechanism, locking positions, non-slip coating, and raised edges to prevent items from slipping, ensuring a secure and comfortable workspace.

A key aspect of the invention is the vertically adjustable axle mechanism, which allows users to easily switch between seated and standing positions. This is facilitated by either a gas-spring lift system or an electric lift system, both providing smooth, controlled adjustments with minimal effort. The integrated power management system includes power strips, wireless charging pads, and organized cable management paths, addressing the common problem of cluttered cables and limited power accessibility in prior art solutions.

Additionally, the invention provides various storage options, such as a ventilated storage compartment for power supplies or laptop docking stations, a roll-out drawer for small office equipment, and a vertical, ventilated slot for a laptop. The modular top assembly can also be compactly folded for easy storage of the trolley, enhancing its versatility in multi-use spaces. The inclusion of a detachable monitor post with rotation and tilt functions, along with integrated LED task lighting, further supports customized and optimized workspace configurations.

The adjustable axle device, integral to the transforming modular trolley, enables ergonomic customization of modular tops. This non-rotating axle device allows for precise vertical adjustments and secure locking at user-selected heights. The device incorporates a dual-chamber gas-spring lift system or an electric lift system with digital memory for pre-set height recall. The rotational coupling with damping reduces vibrations and ensures stability, making it ideal for use with electronic devices.

The invention overcomes limitations found in prior art by providing a fully adjustable, modular solution that caters to diverse user needs and spatial constraints. It eliminates the need for multiple separate pieces of office furniture by integrating functionalities such as height adjustability, power management, and organized storage into a single, cohesive design. This results in a space-saving, ergonomic, and highly functional workstation that promotes productivity and user comfort.

The primary objects of the invention include:

To provide a transforming modular trolley with versatile configurations for office use, supporting both seated and standing positions.

To offer integrated power management and organized cable paths to reduce clutter and enhance the usability of electronic devices.

To incorporate adjustable axle mechanisms that provide smooth and secure height adjustments, supporting ergonomic customization.

To include customizable storage options that optimize space utilization and accommodate various office equipment and personal items.

To deliver a compact, portable design with easy storage capabilities, making the trolley suitable for dynamic office environments.

These and other advantages of the invention will be apparent from the detailed description and accompanying drawings, which illustrate the specific embodiments and features of the transforming modular trolley and adjustable axle device.

According to a first aspect of the invention, there is a transforming modular trolley for office use, comprising: a base mounted on a plurality of non-marring casters for smooth mobility on various floor surfaces; a modular top assembly including: a primary work surface configured for at least one monitor; a dedicated surface for holding a tablet or phone at an angle for ease of viewing; a surface with recessed areas for a plurality of personal items such as a cup and a small office item; a computer mouse surface; a vertically adjustable axle mechanism coupled to said modular top assembly, allowing height adjustments for seated or standing positions; an integrated power management system comprising a power strip, wireless charging pads, cable management paths, and openings for organizing cords; a ventilated storage compartment for housing power supplies, a laptop docking station, or office supplies; a roll-out storage drawer for storing office equipment, such as printers or filing trays, with integrated anti-tip mechanisms for stability; wherein said modular top assembly can be rotated into a compact position for easy storage of said transforming modular trolley and said trolley can be operated from a side utilizing a two-way drawer slide configured to allow said roll-out storage drawer to open from a side of said trolley and said modular top assembly can be positioned for access from said side of said trolley.

Further features of the invention are disclosed in dependent claims as follows.

According to one aspect of the present invention, there is a transforming modular trolley in the form of a modular top assembly offered in various size and design options to accommodate different workspace needs. An advantage of the modular top assembly is the flexibility to customize the trolley for diverse workspace configurations and user preferences.

According to one aspect of the present invention, there is a transforming modular trolley in the form of an integrated power management system including wireless charging pads for cordless charging of compatible electronic devices. An advantage of the wireless charging pads is the ability to conveniently charge devices without the clutter of cables, maintaining a clean and organized workspace.

According to one aspect of the present invention, there is a transforming modular trolley in the form of a storage compartment with a removable, sliding tray designed for storing small electronics or personal items, and includes customizable dividers. An advantage of the removable tray is the efficient organization and accessibility of small items, improving the overall usability of the trolley.

According to one aspect of the present invention, there is a transforming modular trolley in the form of a primary work surface including a magnetic slot for attaching an accessory surface with a magnetically coupled tilt-able rod and locking positions, with raised edges to prevent items from slipping. An advantage of the magnetic slot and accessory surface is its versatility for organizing items and adjusting the work surface to different ergonomic needs.

According to one aspect of the present invention, there is a transforming modular trolley in the form of integrated LED task lighting in the modular top assembly, said lighting being adjustable in brightness and color temperature for various tasks. An advantage of the adjustable LED lighting is the enhanced visibility and customization for different lighting conditions, reducing eye strain and improving focus.

According to one aspect of the present invention, there is a transforming modular trolley in the form of a detachable monitor post with rotating and tilting functions, featuring built-in cable management. An advantage of the detachable monitor post is the ease of adjusting monitor positions for optimal viewing angles, while also keeping cables organized and out of sight.

According to one aspect of the present invention, there is a transforming modular trolley in the form of a base with retractable anti-tip stabilizers that automatically extend when the height of the primary work surface exceeds a predefined threshold. An advantage of the retractable stabilizers is the additional stability they provide, particularly when the trolley is in a standing position, preventing tipping and ensuring user safety.

According to one aspect of the present invention, there is a transforming modular trolley in the form of a vertical, ventilated storage slot for a laptop, enabling the use of an auxiliary keyboard on the primary work surface while the laptop is connected to a docking station. An advantage of the ventilated storage slot is that it facilitates better airflow for cooling the laptop, while allowing for convenient use of peripheral devices like keyboards.

According to one aspect of the present invention, there is a transforming modular trolley in the form of a plurality of non-marring casters with an automatic braking system that engages when the trolley is stationary. An advantage of the automatic braking system is the enhanced stability and prevention of unintentional movement when the trolley is in use.

According to one aspect of the present invention, there is a transforming modular trolley in the form of a roll-out storage drawer coated with non-slip material and raised edges as needed to prevent items from slipping. An advantage of the non-slip coating and raised edges is the secure storage of items during movement, preventing accidental spills or displacement.

According to a second aspect of the invention, there is an adjustable, non-rotating axle device for supporting modular tops in an office environment, comprising: a vertically adjustable axle mechanism that allows height adjustments for ergonomic comfort during seated or standing work; a gas-spring lift system enabling smooth, controlled vertical adjustments with minimal effort; a locking system allowing a user to secure modular tops at desired heights; and a rotational coupling enabling said modular tops to rotate around a vertical axis to positions for ergonomic comfort; wherein said adjustable axle device is intended to be integrated into modular workstations, allowing for height and orientation customization based on user preference.

Further features of the invention are disclosed in dependent claims as follows.

According to one aspect of the present invention, there is an adjustable axle device in the form of a gas-spring lift system including a dual-chamber gas pressure balance mechanism, providing stability and wobble-free height adjustments. An advantage of the dual-chamber mechanism is the enhanced stability during adjustments, reducing wobbling and providing a secure user experience.

According to one aspect of the present invention, there is an adjustable axle device in the form of a safety stop mechanism that prevents the modular tops from descending below a predetermined height. An advantage of the safety stop mechanism is the protection it offers by preventing the modular tops from lowering too far, ensuring user safety during use.

According to one aspect of the present invention, there is an adjustable axle device in the form of a rotational coupling that includes a damping mechanism to reduce vibrations during rotation. An advantage of the damping mechanism is the minimized vibration, ensuring stability for connected devices and a smoother experience for the user.

According to one aspect of the present invention, there is an adjustable axle device in the form of an electric lift system with a digital user interface allowing the user to set and recall pre-set height positions for convenient adjustments. An advantage of the digital interface is the user convenience in quickly returning to preferred height settings, improving ergonomic comfort and efficiency.

According to one aspect of the present invention, there is an adjustable axle device in the form of a gas-spring lift system with a fixed lower limit to prevent the work surface from descending below a user-safe height. An advantage of the fixed lower limit is the safety it ensures, preventing the modular top from descending too low and causing potential harm to the user.

According to a third aspect of the invention, there is an adjustable, non-rotating axle device for supporting modular tops in an office environment, comprising: a vertically adjustable axle mechanism with an electric lift system for smooth, controlled height adjustments during seated or standing work; a locking system that allows modular tops to be secured at a desired height; a rotational coupling enabling said modular tops to rotate around a vertical axis to positions for ergonomic comfort; and an integrated digital memory system that allows a user to save and recall preferred height settings; wherein said adjustable axle device is intended to be integrated into modular workstations, allowing for height and orientation customization based on user preference.

Further features of the invention are disclosed in dependent claims as follows.

According to one aspect of the present invention, there is an adjustable axle device in the form of an electric lift system with a safety mechanism having a fixed lower limit to prevent injury by stopping the work surface from descending below a predetermined height. An advantage of the safety mechanism is the prevention of injury by ensuring the work surface does not descend too low during operation.

According to one aspect of the present invention, there is an adjustable axle device in the form of a rotational coupling that includes a damping mechanism to provide stability and minimize vibrations when rotating the work surface. An advantage of the damping mechanism is the reduction of vibrations, ensuring the stability of devices on the surface and a smoother rotation experience for the user.

The present invention, a transforming modular trolley for office use with an adjustable axle device, offers several key advantages that significantly enhance the flexibility, usability, and efficiency of workspaces. The key benefits of this invention include:

Ergonomic Flexibility: The vertically adjustable axle mechanism allows for smooth transitions between seated and standing work positions, promoting ergonomic comfort and reducing strain for users. The ability to adjust the height of the work surface caters to different user preferences and body types, improving overall well-being during extended periods of work.

Modular Customization: The modular top assembly, with its dedicated surfaces for monitors, tablets, phones, personal items, and a computer mouse, can be customized to meet various workspace needs. Different sizes and configurations offer flexibility in organizing a personalized, functional workspace, making it suitable for both home and professional office environments.

Integrated Power Management: The built-in power management system, featuring a power strip, wireless charging pads, and cable management paths, solves the common problem of cable clutter. This not only helps keep the workspace organized but also ensures that devices remain powered and easily accessible without the need for multiple power outlets or cords.

Compact Storage and Mobility: The ability to rotate the modular top assembly into a compact position and the inclusion of non-marring casters enable easy mobility and storage of the trolley. This is particularly advantageous for users who need to reposition or store the trolley in small or dynamic work environments, improving space efficiency.

Stable and Safe Design: The trolley includes retractable anti-tip stabilizers and an automatic braking system on the casters, providing enhanced stability and safety when the work surface is in a raised position or when the trolley is stationary. These features meet necessary stability safety requirements, ensuring the safety of both the user and the equipment.

Enhanced Storage Options: The invention offers a variety of storage compartments, including a ventilated storage slot for laptops, a roll-out storage drawer for small office equipment, and customizable trays for organizing personal items. These features improve workspace organization and ensure that essential tools and devices are readily accessible.

Improved User Experience: The inclusion of features like integrated LED task lighting with adjustable brightness and color temperature, as well as a detachable monitor post with rotation and tilt functions, enhances the overall user experience. These features provide better lighting conditions, improved viewing angles, and an optimized workspace for increased productivity.

Safety and Stability in Height Adjustments: The adjustable axle device is designed with stability in mind, including a dual-chamber gas-spring lift system, safety stop mechanisms, and a damping mechanism to reduce vibrations. This ensures that height adjustments are smooth, secure, and wobble-free, offering a safe and comfortable experience for users.

Customizable Height and Orientation: The invention's digital user interface allows users to set and recall preferred height positions, making it easier to customize the work surface height to their exact preferences. This feature improves efficiency and saves time by allowing quick adjustments to previously saved settings.

Sustainable and Practical Design: The modular nature and storage solutions provided by the invention contribute to an efficient and organized workspace. The trolley is built with sustainability in mind, minimizing the need for multiple separate pieces of office furniture and offering an all-in-one solution for modern work environments.

These advantages collectively make the transforming modular trolley a highly versatile, functional, and ergonomic solution for contemporary office setups, providing both practical workspace management and enhanced user comfort.

The invention will now be described, by way of example only, with reference to the accompanying drawings in which:

DETAILED DESCRIPTION OF THE INVENTION

The detailed embodiments of the present invention are disclosed herein. The disclosed embodiments are merely exemplary of the invention, which may be embodied in various forms. The details disclosed herein are not to be interpreted as limiting, but merely as the basis for the claims and as a basis for teaching one skilled in the art how to make and use the invention.

References in the specification to "one embodiment," "an embodiment," "an example embodiment," etcetera, indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to effect such feature, structure, or characteristic in connection with other embodiments whether or not explicitly described.

Furthermore, it should be understood that spatial descriptions (e.g., "above," "below," "up," "left," "right," "down," "top," "bottom," "vertical," "horizontal," etc.) used herein are for purposes of illustration only, and that practical implementations of the structures described herein can be spatially arranged in any orientation or manner.

Throughout this specification, the word "comprise," or variations thereof such as "comprises" or "comprising," will be understood to imply the inclusion of a stated element, integer or step, or group of elements integers or steps, but not the exclusion of any other element, integer or step, or group of elements, integers or steps.

Figure 1:
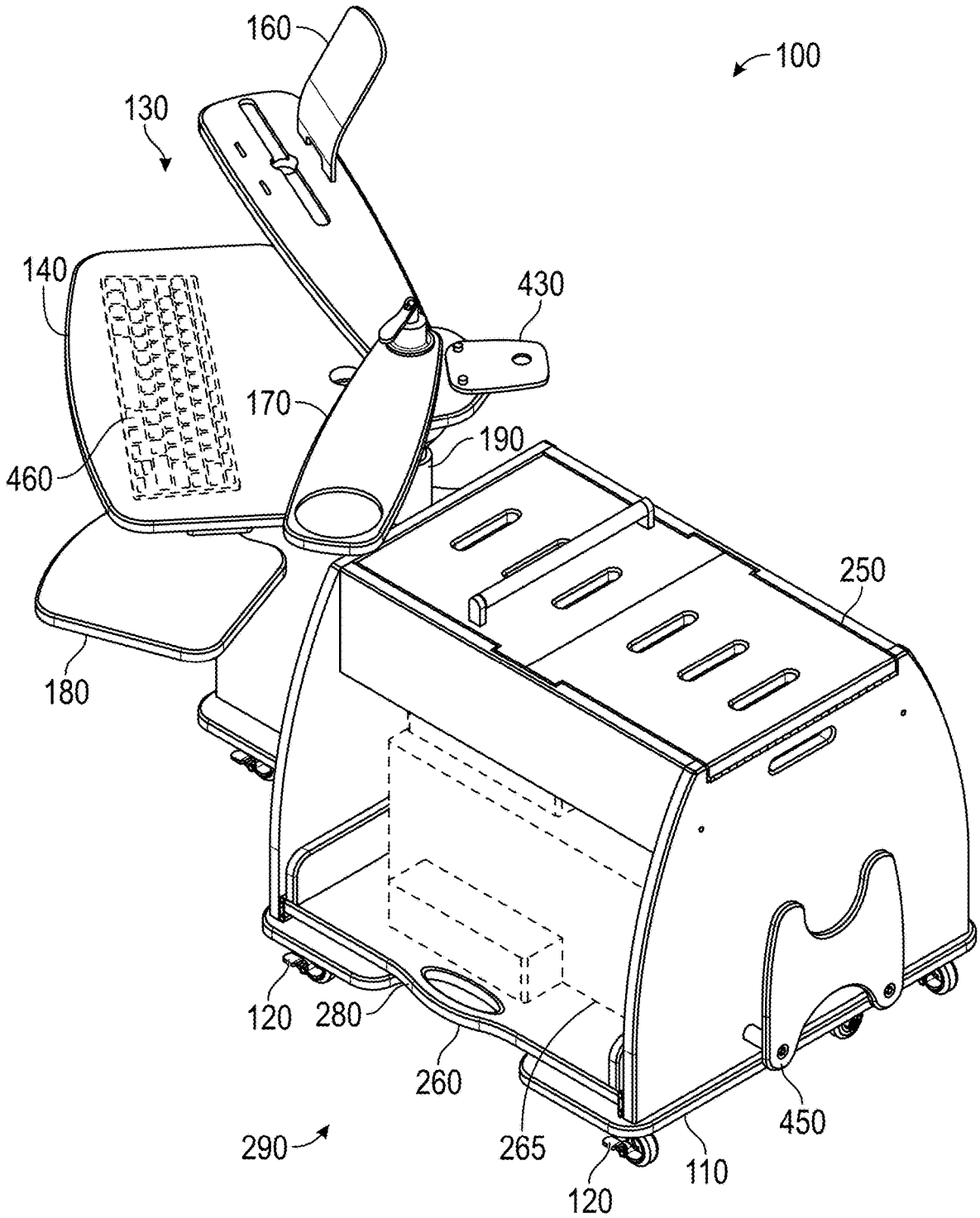
FIG. 1 is a perspective view of the modular transforming trolley with adjustable axle mechanism for office use according to the invention.
Figure 2:
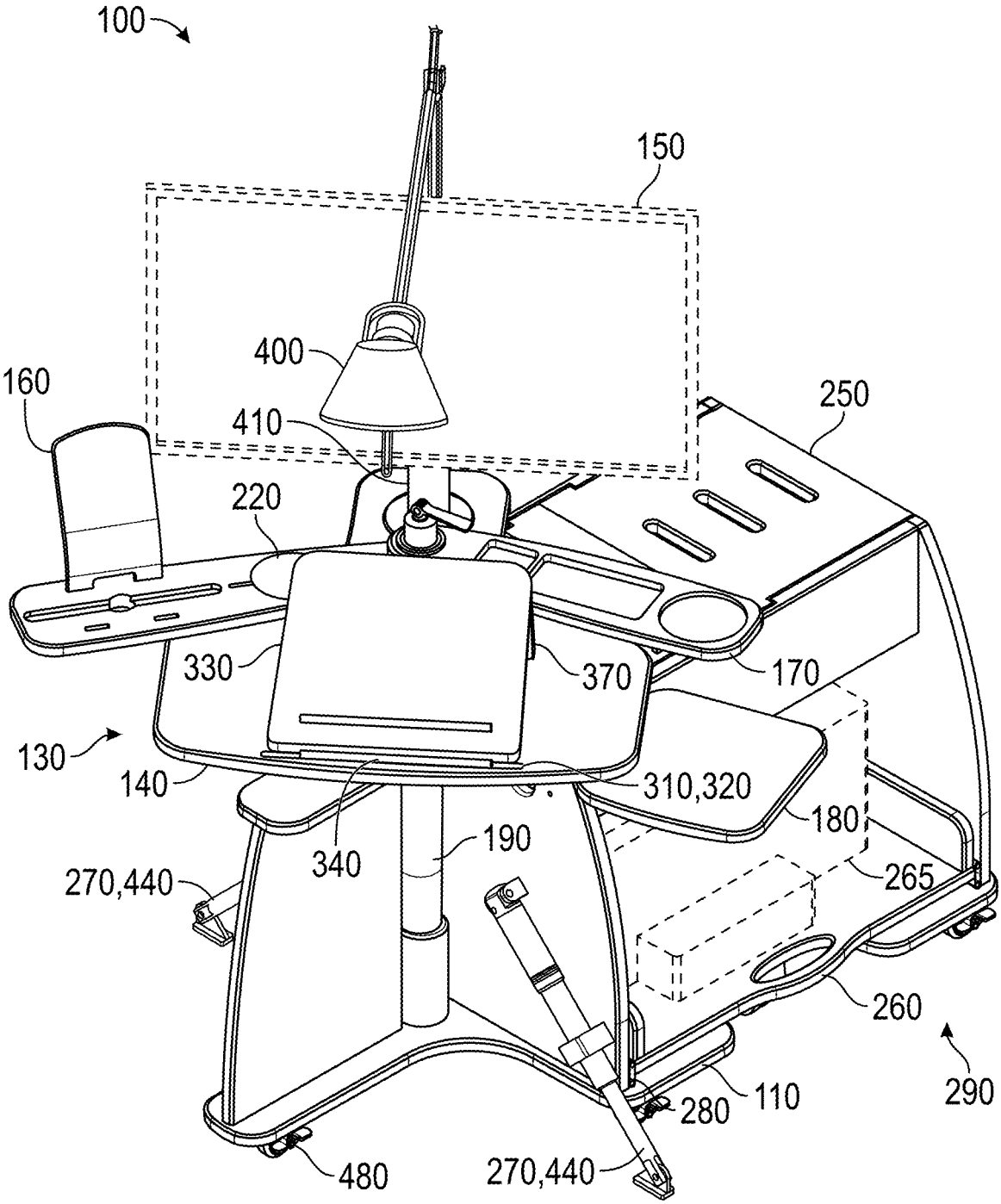
FIG. 2 is a perspective view of the modular transforming trolley with adjustable axle mechanism for office use with a computer monitor, lamp, and accessory surface according to the invention.
Figure 3:
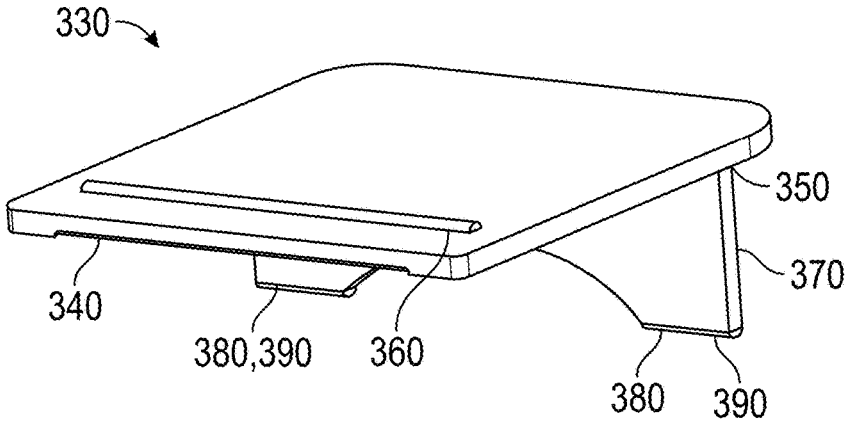
FIG. 3 is a perspective view of the accessory surface of the modular transforming trolley with adjustable axle mechanism for office use according to the invention.
Figure 4A:
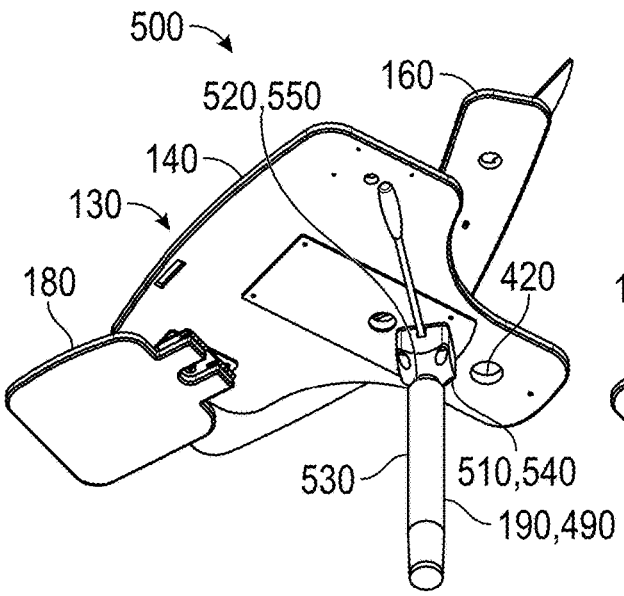
FIG. 4A is an underside perspective view showing the gas lift axle mechanism of the modular transforming trolley with adjustable axle mechanism for office use according to the invention.
Figure 4B:
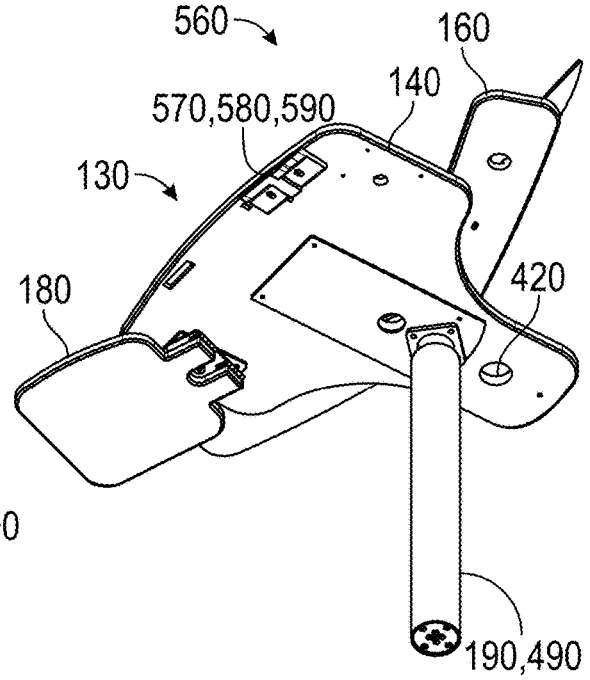
FIG. 4B is an underside perspective view showing the electric lift axle mechanism of the modular transforming trolley with adjustable axle mechanism for office use according to the invention.
Figure 5:
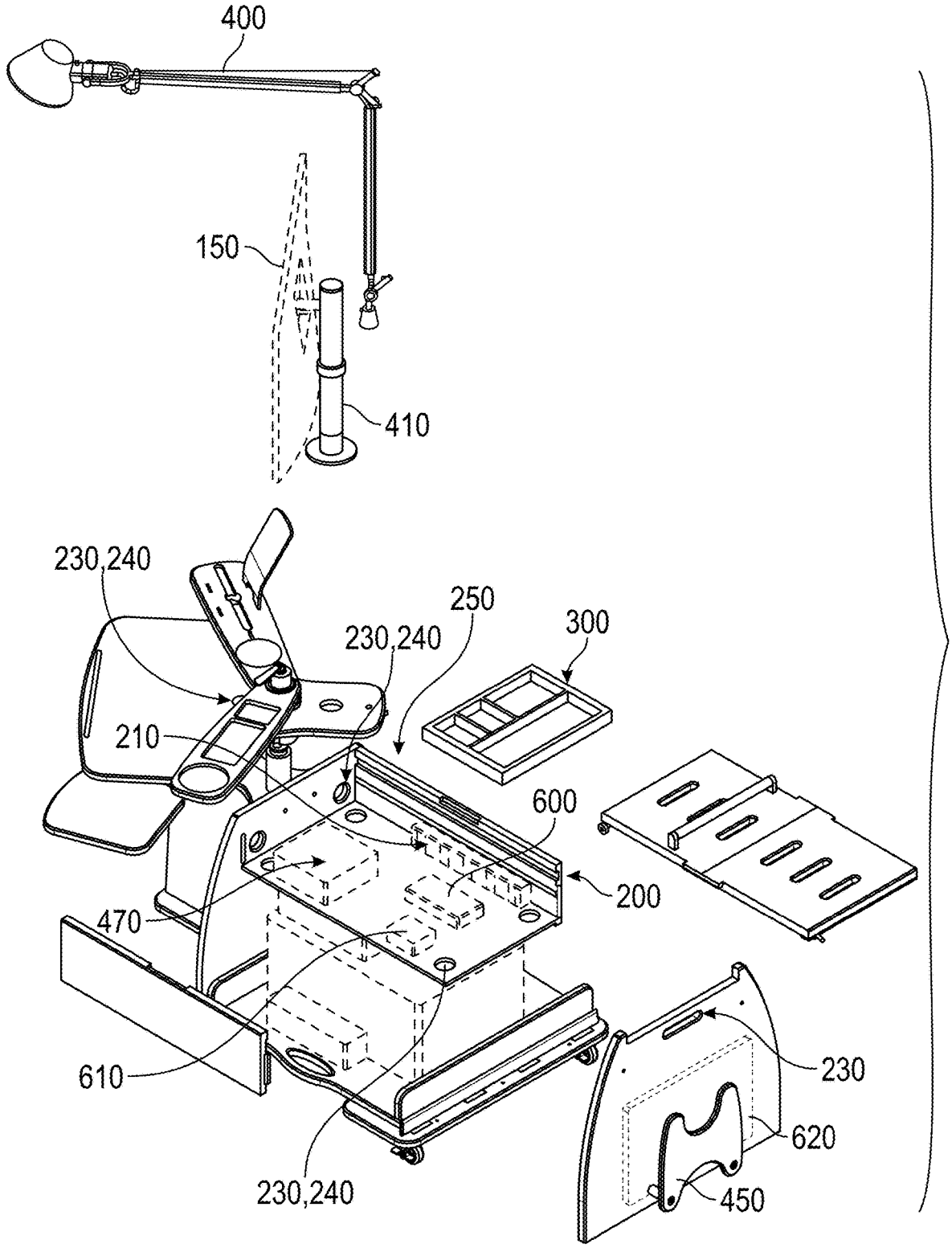
FIG. 5 is an exploded view of the modular transforming trolley with adjustable axle mechanism for office use according to the invention.

Index of Labelled Features in Figures. Features are listed in numeric order by Figure in numeric order. Referring to the Figures, there is shown in FIGS. 1, 2, 3 and 4 the following features:

Element 100 which is a transforming modular trolley.

Element 110 which is a base.

Element 120 which is a non-marring caster.

Element 130 which is a modular top assembly.

Element 140 which is a primary work surface.

Element 150 which is an auxiliary monitor.

Element 160 which is a dedicated surface for holding a tablet or a phone.

Element 170 which is a surface with recessed areas for a plurality of personal items such as a cup or a small office item.

Element 180 which is a computer mouse surface.

Element 190 which is a vertically adjustable axle mechanism.

Element 200 which is an integrated power management system.

Element 210 which is a power strip.

Element 220 which is a wireless charging pad.

Element 230 which is a cable management path.

Element 240 which is an opening for organizing cords.

Element 250 which is a ventilated storage compartment for housing power supplies, a laptop docking station, or office supplies.

Element 260 which is a roll-out storage drawer for storing office equipment, such as printers or filing trays.

Element 265 which is an auxiliary printer.

Element 270 which is an integrated anti-tip mechanism.

Element 280 which is a two-way drawer slide.

Element 290 which is a side of said transforming modular trolley.

Element 300 which is a removable, sliding tray of the storage compartment.

Element 310 which is a slot.

Element 320 which is a magnetic connection.

Element 330 which is an accessory surface.

Element 340 which is a magnetically coupled tilt-able rod.

Element 350 which is a locking position of the riser panel.

Element 360 which is a raised edge of the accessory surface.

Element 370 which is a riser panel.

Element 380 which is a bumper on the riser panel.

Element 390 which is a bottom edge of the riser panel.

Element 400 which is an integrated LED task lighting.

Element 410 which is a detachable monitor post with the option of mounting up to two monitors.

Element 420 which is a built-in cable management for organizing and concealing cords in detachable monitor post.

Element 440 which is a retractable anti-tip stabilizer.

Element 450 which is a vertical, ventilated storage slot for a laptop.

Element 460 which is an auxiliary keyboard.

Element 470 which is an auxiliary laptop docking station.

Element 480 which is an automatic braking system.

Element 490 which is an adjustable, non-rotating axle device for supporting modular tops in an office environment.

Element 500 which is a gas-spring lift system.

Element 510 which is a locking system.

Element 520 which is a rotational coupling.

Element 530 which is a dual-chamber gas pressure balance mechanism.

Element 540 which is a safety stop mechanism.

Element 550 which is a damping mechanism.

Element 560 which is an electric lift system.

Element 570 which is a digital user interface.

Element 580 which is a fixed lower limit.

Element 590 which is an integrated digital memory system.

Element 600 which is a laptop power supply.

Element 610 which is a monitor power supply.

Element 620 which is a laptop.

The adjustable axle significantly improves ergonomics by allowing users to customize the height and orientation of their work surface to suit their individual comfort and needs. Here are the key ways in which an adjustable axle enhances ergonomics:

Facilitates a Neutral Posture: Customizable Height Adjustments: The adjustable axle allows the work surface to be easily raised or lowered, enabling users to position their workspace at the ideal height. This flexibility helps maintain a neutral posture, where the user's arms, wrists, and elbows are in a comfortable and natural position while working. A neutral posture reduces strain on the body and minimizes the risk of repetitive stress injuries. Sitting and Standing Transitions: By enabling seamless transitions between sitting and standing heights, the adjustable axle allows users to alternate between these two positions throughout the day. Standing intermittently while working can reduce the risks associated with prolonged sitting, such as back pain and circulation problems, and promote better overall health.

Reduces Physical Strain: Minimizes Reaching and Bending: The adjustable axle allows users to bring their work surface to the appropriate height, reducing the need to bend, reach, or hunch over, which can cause discomfort and strain in the neck, shoulders, and lower back. For example, a user can adjust the height of their monitor or laptop to be at eye level, preventing neck strain. Improves Accessibility: For users of different heights or those with physical limitations, the ability to adjust the axle ensures that the workstation can be tailored to their specific ergonomic needs. This reduces the physical effort required to interact with their workspace.

Supports Multiple Postures: Flexible Positioning for Various Activities: Different tasks often require different postures. For example, typing might require a lower work surface, while drawing or reading may be more comfortable at a higher level. The adjustable axle allows the user to quickly change the work surface height to accommodate various activities, ensuring that the workstation is always ergonomically optimized for the task at hand. Personalized Adjustments: Because the adjustable axle can be fine-tuned to the user's exact preference, it supports a more personalized ergonomic setup compared to fixed-height desks. This is especially useful in shared workspaces, where different users can adjust the setup according to their individual ergonomic requirements.

Enhances Comfort Over Extended Periods: Reduces Fatigue: Ergonomic workstations that accommodate standing and sitting variations help reduce fatigue by allowing users to change positions throughout the day. Standing periodically while working improves circulation, reduces muscle stiffness, and can prevent the feeling of fatigue that often accompanies long periods of sitting. Mitigates Long-Term Health Issues: Poor posture and ergonomics over time can lead to chronic health problems, including musculoskeletal disorders and joint issues. The adjustable axle, by supporting proper posture and reducing strain, can help mitigate these long-term health risks, promoting better overall well-being.

Provides a User-Centric Experience: Quick and Easy Adjustments: The inclusion of a gas-spring or motorized system in the adjustable axle can make height adjustments smooth and effortless, encouraging users to make ergonomic adjustments regularly. The ease of adjustment means users are more likely to utilize the feature, rather than compromising their posture by working at an improper height. Encourages Movement: The ability to quickly adjust the work surface promotes movement and activity, which are key principles in ergonomic design. Encouraging users to shift positions throughout the day helps maintain comfort and reduces the likelihood of stiffness or strain. The adjustable axle improves ergonomics by making the workstation more adaptable to the user's body and task-specific needs. By allowing for height adjustments that accommodate both sitting and standing positions, reducing physical strain, supporting neutral postures, and encouraging movement, the adjustable axle helps create a more comfortable, healthy, and productive work environment. The adjustable axle in a modular transforming trolley can significantly enhance a variety of tasks by enabling the user to adjust the height and orientation of the work surface to suit the specific demands of the activity. Here are some specific tasks that benefit from the adjustable axle:

Typing and Computer Use: Task Benefits: When typing on a laptop or using a desktop computer, proper screen height and keyboard placement are essential to avoid neck and wrist strain. The adjustable axle allows the work surface to be set at the ideal height, ensuring that the keyboard is positioned correctly for typing, and the monitor is at eye level to reduce neck strain. Ergonomic Advantage: Users can easily transition between sitting and standing while typing, promoting better posture and reducing the risks associated with prolonged sitting.

Drawing, Sketching, and Writing: Task Benefits: Artists and designers who draw, sketch, or write often need their work surface to be positioned at different heights and angles depending on the task. The adjustable axle allows for fine-tuning the work surface to a comfortable height and, in some designs, tilting the surface for better hand positioning.

Ergonomic Advantage: The ability to adjust the height and angle helps reduce wrist strain and promotes a more comfortable and natural posture, improving accuracy and endurance during creative tasks.

Reading Documents: Task Benefits: Reading documents for extended periods can strain the neck and back if the work surface is too low. The adjustable axle enables users to raise the work surface to a comfortable reading height, reducing the need to hunch over or strain the neck. Ergonomic Advantage: By adjusting the height to eye level, users can maintain a neutral spine position, reducing neck and upper back tension.

Meetings and Presentations: Task Benefits: During meetings or presentations, the adjustable axle allows the user to raise the work surface to a standing height, facilitating a more engaging and dynamic presentation style. It can also help to position a laptop, monitor, or notes at the optimal height for visibility. Ergonomic Advantage: Presenters can avoid hunching over a low desk, stand comfortably, and move more freely, reducing fatigue during longer presentations.

Video Conferencing: Task Benefits: Video conferencing requires the camera to be at eye level for the best appearance on screen. The adjustable axle and monitor post allow users to raise or lower their laptop or monitor to ensure the camera is positioned at the correct height, avoiding awkward angles and promoting a more professional image. Ergonomic Advantage: Adjusting the height for video calls reduces neck strain and ensures that the user is sitting comfortably while maintaining good posture during extended meetings.

Crafting and Assembly Work: Task Benefits: For tasks that involve crafting, assembling products, or working with tools, users may need the work surface at a higher or lower level depending on the task. The adjustable axle enables quick adjustments to bring the work surface to a comfortable height, whether the user is standing or sitting. Ergonomic Advantage: Being able to adjust the height reduces the risk of back and shoulder strain caused by bending over a low surface or reaching up to a higher one.

Document Review and Signing: Task Benefits: Reviewing and signing documents often requires a stable, flat surface at a comfortable height. The adjustable axle allows users to set the work surface at the correct level for easy reading, writing, or signing. Ergonomic Advantage: Adjusting the surface to the optimal height prevents unnecessary bending and strain, making the process more comfortable and efficient.

Cooking and Recipe Review (Kitchen Tasks): Task Benefits: In home office setups that double as kitchen spaces, the adjustable axle allows the work surface to be used for reviewing recipes, prepping ingredients, or even holding a tablet or laptop for cooking instructions. The height can be adjusted to suit either standing or sitting positions while working in the kitchen. Ergonomic Advantage: The flexibility of height adjustment prevents back strain by allowing users to bring the surface to the right level for kitchen tasks, reducing the need to bend over or stretch.

Gaming: Task Benefits: Gamers often need to adjust their setup to find the most comfortable position for long gaming sessions. The adjustable axle allows the height of monitors, keyboards, and consoles to be adjusted for optimal viewing and control access. Ergonomic Advantage: Adjusting the height to the user's preference promotes better posture, reduces strain on the eyes and neck, and improves comfort during extended gaming sessions.

Training and Learning (e.g., Online Courses): Task Benefits: When attending online classes or training sessions, the adjustable axle allows users to set up their workstation at the appropriate height for watching instructional videos, typing notes, or interacting with digital content. Ergonomic Advantage: Properly adjusting the workstation height for learning activities helps users maintain focus and comfort, avoiding physical discomfort that can detract from learning.

The adjustable axle enhances ergonomics across a wide variety of tasks by enabling users to tailor the height and positioning of their work surface to the specific demands of each activity. This adaptability improves comfort, reduces physical strain, and promotes better posture, leading to a more productive and health-conscious working experience.

Refining the design of the modular transforming trolley involves enhancing its functionality, aesthetics, and ergonomics, while also considering practical features that address the needs of home office users. Below are some suggestions to refine the trolley design:

Ergonomic Enhancements: Advanced Height Adjustability: Incorporate a gas-spring or motorized adjustable axle mechanism with smooth and effortless transitions between sitting and standing heights. Additionally, include pre-set height memory buttons to allow users to quickly adjust the trolley to their preferred height settings. Tilt-able Work Surface: Design the primary work surface to have a tilt function with multiple locking positions. This allows users to adjust the angle for tasks such as typing, drawing, or reading, ensuring comfort across various activities. Rotatable Monitor Post: Integrate a fully adjustable monitor post that can rotate, tilt, and swivel to achieve optimal viewing angles. The post should be designed to support various screen sizes and weights, with built-in cable management to keep cords tidy.

Aesthetic and Material Refinements: Sleek, Minimalist Design: Focus on a modern, minimalist aesthetic using clean lines and a neutral color palette (e.g., matte black, white, or natural wood finishes). This would allow the trolley to blend seamlessly into different home office setups. High-Quality Materials: Use eco-friendly materials, such as sustainably sourced wood for the work surface and recycled metal or aluminum for the frame. The use of durable, high-quality materials ensures that the trolley is long-lasting and environmentally responsible. Textured Surfaces: Add non-slip textures to the work surface, preventing devices from sliding, especially when the surface is tilted. This could include rubberized coatings or textured laminates that are also easy to clean.

Storage and Organization Features: Modular Storage Compartments: Include modular storage compartments that can be reconfigured based on user needs. These could include sliding trays, drawers, and side storage baskets for holding office supplies, cables, or personal items. Magnetic or clip-on accessories could be introduced to add more versatility. Hidden Cable Management: Refine the integrated cable management system to conceal all cables, including those from the power outlets, USB ports, and monitor post. Add snap-fit cable organizers and concealed channels to keep cables out of sight and prevent tangling. Compact Drawer Design: Introduce a slim, pull-out drawer under the work surface for storing essentials such as pens, notebooks, and devices. The drawer could be designed with dividers to keep items organized.

Mobility and Stability Improvements: High-Quality Casters: Equip the trolley with premium, lockable casters that glide smoothly across various surfaces, including hardwood, carpet, and tile. The casters should include a braking system that engages automatically when the trolley is stationary, adding stability during use. Retractable Stabilizers: To enhance stability when the trolley is used in its standing position, incorporate retractable stabilizers that extend from the base when the work surface is raised above a certain height. These stabilizers can help prevent tipping and add extra security for heavier equipment.

Technology Integration: Integrated Wireless Charging: Embed wireless charging pads into the work surface, allowing users to charge their devices without the need for additional cables. These pads could be positioned in strategic locations on the surface to accommodate multiple devices. Built-In Power Strip with USB Ports: Design the trolley with a built-in power strip that includes standard outlets and high-speed USB ports. This allows users to easily connect and charge devices such as laptops, phones, and tablets directly from the trolley. LED Lighting: Add integrated LED task lighting over the work surface or monitor post. The lighting should be adjustable in both brightness and color temperature to suit different working conditions (e.g., warm light for reading, bright light for detailed work).

Space Efficiency: Compact, Space-Saving Design: Optimize the overall dimensions of the trolley to make it compact enough for small home offices or multi-purpose rooms, while still providing ample workspace and storage. Foldable or retractable components could be incorporated to save space when the trolley is not in use. Detachable Components: Design detachable components, such as side trays or accessory holders, that can be added or removed based on the user's specific needs. This modularity allows the trolley to adapt to different tasks and space constraints.

User Experience and Safety: User-Friendly Adjustments: Ensure that all adjustable features, including the axle mechanism, tilt-able work surface, and monitor post, are easy to operate with one hand. Controls should be intuitive and accessible, reducing the effort required to make adjustments. Safety Features: Incorporate safety stops in the adjustable axle mechanism to prevent the work surface from lowering too far or unexpectedly shifting. Additionally, use rounded edges on the work surface and other components to prevent injury. Quiet Operation: Focus on minimizing noise during adjustments and movement. Quiet casters and smooth-operating mechanisms will reduce distractions and make the trolley more suitable for shared or open-plan home environments.

Final Concept: The refined modular transforming trolley would be a sleek, modern, and highly functional workstation tailored for home office use. With its ergonomic features, such as an adjustable axle, tilt-able work surface, and customizable storage, it would support a range of tasks while ensuring user comfort. The trolley's eco-friendly materials and space-efficient design would appeal to environmentally conscious users and those with limited workspace. Integrated technology, including wireless charging, built-in power management, and task lighting, would make the trolley a versatile and tech-friendly addition to any home office.

How to Make the Present Invention

The present invention, a transforming modular trolley for office use, integrates innovative features such as a modular top assembly, vertically adjustable axle mechanism, horizontally adjustable rotational mechanism, integrated power management, articulating accessory surfaces, and enhanced safety features. Below are detailed, step-by-step instructions on how to manufacture each key component of the invention.

Base and Casters Assembly—The foundation of the trolley is its base, which must be made from high-strength materials such as high quality hardwood plywood, bamboo plywood, steel, aluminum, or reinforced polymers. The base is designed to support the weight of the top assembly and any devices or equipment placed on the work surface.

Non-marring Casters: To ensure smooth mobility, affix a plurality of non-marring casters to the base. These casters should feature polyurethane or rubber tires, which will protect delicate flooring surfaces such as hardwood, tile, or carpet. Ensure the casters can rotate 360 degrees for maximum maneuverability.

Automatic Braking System: Incorporate an automatic braking system into the casters, which activates when the trolley is stationary. This braking system prevents unintentional rolling and provides extra stability, particularly when the trolley is in use or when the primary work surface is adjusted to standing height.

Horizontally Adjustable Coupling: The horizontally adjustable coupling provides the ability to orient the multiple work surfaces around the vertically adjustable axle for ergonomic comfort.

Vertically Adjustable Axle Mechanism: The vertically adjustable axle mechanism is one of the core components of the invention, allowing the work surface to be raised or lowered for seated or standing use. Depending on the version of the invention, you can use one of two systems:

Gas-Spring Lift System: For manual adjustments, integrate a dual-chamber gas-spring lift system. This system enables smooth and effortless vertical adjustments while ensuring stability through pressure balance. The dual-chamber design reduces wobbling, ensuring a stable work surface even during height changes. The locking system ensures the work surface can be secured at any chosen height, providing flexibility for users of different heights and ergonomic needs. The gas-spring system must be precisely tuned to support the weight of the work surface and any devices placed on it.

Electric Lift System: In the electric version, install a motorized lift with a digital control interface. The user should be able to electronically raise or lower the work surface and store pre-set height positions in the system's memory. The electric lift mechanism must also include safety stop mechanisms to prevent the surface from descending below a pre-defined, user-safe height. A limit switch or optical sensor can ensure that the work surface never lowers to a level that could endanger the user or damage equipment.

Modular Top Assembly—Constructing the modular top assembly requires designing a versatile surface that meets multiple office needs, with dedicated areas for various devices and accessories.

Primary Work Surface: The primary work surface should be crafted from durable materials such as wood veneer, metal, or high-impact polymer, depending on the design. Coat the surface with a non-slip material such as polyurethane, providing stability for items placed on it, even when tilted. Tilt-able Mechanism: Attach a tilt-able mechanism to the primary work surface that allows the user to adjust the angle for different tasks such as typing, drawing, or reading. Incorporate a locking feature so the user can secure the surface at any desired angle. Raised Edges: Add raised edges along the sides or front of the work surface, particularly near the tilt-able sections. This ensures that items like books, electronics, or pens remain securely on the surface, even when tilted at a steep angle.

Dedicated Surfaces: Tablet or Phone Holder: Design a dedicated surface that holds a tablet or phone at a comfortable viewing angle. This surface should feature recessed areas to cradle devices securely and may include a slot for charging cables. Surface for Personal Items: Add recessed areas specifically designed for personal items like cups, notepads, or other office supplies. The recessed design helps prevent items from slipping or tipping over, especially during trolley movement. Computer Mouse Surface: Integrate a separate, smooth surface specifically for mouse use. This surface should be large enough to provide sufficient room for movement during work tasks.

Articulating Accessory Surface—The articulating accessory surface is an optional but valuable addition, providing users with extra space and flexibility for holding additional items.

Magnetic Coupling System: Equip the articulating accessory surface with a steel rod along its bottom edge, which can magnetically couple to the primary work surface. Use neodymium magnets for strong magnetic coupling, ensuring the accessory surface stays securely attached but can be repositioned easily as needed. This magnet system allows for smooth articulation of the accessory surface while maintaining stability.

Riser Panel: The riser panel provides adjustable support for the articulating accessory surface. Design this riser panel with multiple slots along the back of the accessory surface, allowing the riser panel to lock into different positions for height and angle customization. The riser panel should be built from lightweight yet sturdy materials, such as aluminum, and incorporate a polyurethane bumper at the bottom edge. This bumper will cushion the riser panel's contact with the work surface, preventing scratches and reducing noise during adjustments.

Rod for Item Security: Incorporate a rod along the bottom edge of the articulating accessory surface. This rod can be round, hexagonal, or another geometric shape, and is designed to hold personal items securely in place. When the surface is tilted, this rod prevents items like documents or devices from sliding off the edge.

Storage Compartment and Drawer—The invention includes multiple storage solutions to enhance organization and accessibility.

Ventilated Storage Compartment: Construct a ventilated compartment beneath the primary work surface for storing larger items such as power supplies or laptop docking stations. Add ventilation holes or mesh panels to ensure airflow, preventing overheating of electronic devices.

Roll-Out Storage Drawer: Design a roll-out drawer with anti-tip mechanisms to ensure stability when the drawer is extended. This drawer should be fitted with two-way drawer slides, enabling it to open from either side of the trolley. The drawer should include customizable dividers to allow users to organize small office equipment, such as pens, chargers, or notebooks.

Power Management System—Install an integrated power management system into the modular top assembly.

Power Strip: Include a built-in power strip with multiple outlets for charging and powering office equipment. Position the power strip in a location that allows easy access without interfering with workspace functionality.

Wireless Charging Pads: Embed wireless charging pads into the primary or dedicated work surface, allowing users to charge devices without the need for additional cords. Ensure compatibility with modern wireless charging standards such as Qi to support a wide range of devices.

Cable Management Paths: Implement discreet cable management paths and openings that allow users to route cables neatly out of sight, keeping the workspace clean and organized.

LED Task Lighting and Monitor Post

LED Task Lighting: Add integrated LED lighting to the modular top assembly. This lighting should feature adjustable brightness and color temperature settings, allowing users to customize the lighting environment to suit different tasks and times of day. LEDs should be energy-efficient and long-lasting, with easy-to-use controls located within reach on the work surface.

Monitor Post and Cable Management: The detachable monitor post should be designed to adjust height, rotate, tilt, and swivel for optimal monitor positioning. The post should also include built-in cable management channels to keep power and data cables organized and out of sight, contributing to a tidy workspace.

How to Use the Present Invention

The transforming modular trolley is designed to be intuitive and adaptable, with multiple configurations that cater to a variety of work needs. Here's how users can make the most of the trolley's innovative features:

The transforming modular trolley facilitates seamless transition between a primary office and a remote location. The configuration illustrated in FIG. 1 enables a user to easily relocate their laptop from the primary office to a remote setting. By integrating one or two monitors and ensuring access to Wi-Fi or a hotspot, the user can connect their laptop's power supply to the trolley via a USB cable. This setup allows immediate access to office communications and files, providing an efficient and ergonomic workspace with minimal effort.

Adjusting the Height for Ergonomics: To adjust the height of the primary work surface, the user can manually lift or lower the surface using the gas-spring lift system, which provides smooth movement and secure locking at any height. In the electric version, users can operate the digital control interface to adjust the height electronically. This system allows users to recall saved height settings, so they can switch between seated and standing positions with ease.

Tilting the Work Surface for Comfort: The user can tilt the primary work surface by unlocking the tilt mechanism. This allows for an angle adjustment that improves ergonomics for tasks like reading, drawing, or typing. After finding the desired angle, the user can lock the surface in place to maintain the tilt securely.

Utilizing the Articulating Accessory Surface: To adjust the articulating accessory surface, the user can easily detach and reposition the magnetically coupled steel rod at the bottom of the accessory surface. The user can also adjust the height and angle by moving the riser panel into different slots, customizing the setup for specific tasks such as holding a tablet or other materials.

Organizing and Storing Items: The user can place laptops, power supplies, or other office supplies into the ventilated storage compartment for secure storage and proper ventilation. The roll-out storage drawer can be used for small office items, which can be organized using the customizable dividers. The drawer can be accessed from either side of the trolley, adding convenience in tight spaces.

Power Management and Charging Devices: The integrated power management system allows the user to connect devices directly to the built-in power strip. The wireless charging pads enable cordless charging for compatible devices, helping reduce cord clutter on the desk.

Adjusting the Lighting and Monitor Position: Users can adjust the LED task lighting to their desired brightness and color temperature, ensuring optimal lighting for work. The detachable monitor post allows for easy positioning of monitor(s) for ergonomic viewing, and the built-in cable management keeps the workspace neat and organized.

Moving and Storing the Trolley: When needed, the user can move the trolley easily thanks to the non-marring casters, which provide smooth movement across various surfaces. When stationary, the automatic braking system ensures the trolley remains securely in place. If the trolley needs to be stored, the user can rotate the modular top assembly into a compact position, making it easy to tuck away in a small space.

Safety and Stability During Use: When the user raises the work surface to a standing position, the retractable anti-tip stabilizers automatically extend to provide additional support, preventing the trolley from tipping over. The anti-tip stabilizers can also be activated for additional stability if a large primary work surface or wide curved or dual monitors are used. The polyurethane bumpers on the riser panel and the safety stop mechanisms in the axle system also ensure that the user can adjust and use the trolley without fear of damage or injury.

By following these detailed instructions, the user can take full advantage of the invention's features to create a more efficient, organized, and ergonomic workspace.

A preferred embodiment of the present invention comprises a transforming modular trolley for office use, designed to offer versatile and ergonomic solutions for modern workspaces. The trolley includes a base mounted on a plurality of non-marring casters, which provide smooth mobility on various floor surfaces, such as hardwood, tile, or carpet, without causing damage. These casters allow the trolley to be easily repositioned within a workspace while ensuring smooth movement. Additionally, the base incorporates a braking system to secure the trolley when stationary, ensuring user safety and stability during use.

The modular top assembly of the trolley is an essential feature, providing a highly customizable work surface. The top assembly includes: A primary work surface configured to support at least one monitor, constructed with high-strength materials and a non-slip coating to prevent items from moving during use. The surface may also include options for height and tilt adjustments, improving user comfort. A dedicated surface for holding a tablet or phone at an ergonomic viewing angle, ensuring ease of access and visibility during work tasks, such as video conferencing or multitasking with different devices. A surface with recessed areas for personal items like cups or office supplies. These recessed sections provide secure locations for items, preventing them from sliding off when the trolley is moved or when the work surface is tilted. A computer mouse surface designed for smooth and precise mouse operation, enhancing productivity for users who rely on this tool for their tasks.

The vertically adjustable axle mechanism enables smooth transitions between seated and standing work positions, promoting healthier and more ergonomic work habits. The adjustment is facilitated by a gas-spring lift system or an electric lift system, allowing the user to easily raise or lower the top assembly to suit their preferred working height. This height adjustment caters to a wide range of user preferences, making the trolley suitable for individuals of different heights and working styles.

The integrated power management system simplifies cable management and keeps electronic devices charged. The power system includes a power strip with multiple outlets for standard office equipment and wireless charging pads embedded within the work surface, providing a clutter-free charging solution for compatible devices. Cable management paths and openings are strategically placed to route and conceal cords, ensuring that the workspace remains organized and free of tangles.

The trolley also features a ventilated storage compartment, providing a dedicated space for housing power supplies, laptop docking stations, or other office equipment. This compartment is equipped with ventilation panels to prevent overheating, ensuring that electronic devices stored within can operate safely without the risk of damage from heat buildup.

The roll-out storage drawer offers a secure and stable storage solution for small office equipment, such as printers, filing trays, or personal items. It includes anti-tip mechanisms that prevent the drawer from destabilizing the trolley when fully extended. The drawer is mounted on a two-way slide, allowing it to be accessed from either side of the trolley, providing maximum flexibility in various workspace layouts. This feature allows the user to position the trolley in tight spaces or against walls while still having easy access to storage.

The modular top assembly can be rotated into a compact position, making the trolley easy to store when not in use. This is especially useful in multi-purpose workspaces where space efficiency is critical. When needed, the trolley can be quickly re-deployed, with the top assembly repositioned for convenient access and ergonomic use.

An alternate embodiment of the present invention includes the modular top assembly offered in a variety of sizes and designs. This allows users to choose the configuration that best suits their workspace needs, whether they require more space for multiple monitors or a compact setup for smaller desks. These different configurations ensure the trolley can adapt to diverse work environments, enhancing its versatility.

An alternate embodiment of the present invention includes wireless charging pads integrated into the power management system, providing a convenient, cord-free charging solution for compatible devices. By eliminating the need for multiple charging cables, this feature reduces clutter on the work surface and simplifies device management for users who frequently charge their phones, tablets, or other wireless-charging-capable devices.

An alternate embodiment of the present invention includes a removable, sliding tray in the storage compartment, designed for storing small electronics or personal items. The tray can be customized with adjustable dividers, allowing users to organize their belongings according to their specific needs. This feature ensures that small items, such as pens, headphones, or chargers, remain easily accessible and well-organized within the trolley.

An alternate embodiment of the present invention includes a primary work surface with a magnetic slot for attaching an accessory surface. This accessory surface is designed to be magnetically coupled to the primary work surface via a tilt-able rod, which offers multiple locking positions to accommodate different angles for various tasks. The accessory surface features a raised edge parallel to the rod, preventing items from slipping off when the surface is tilted. Additionally, a riser panel with a polyurethane bumper is included, providing support and protection for the accessory surface while ensuring smooth adjustments between locking positions.

An alternate embodiment of the present invention includes integrated LED task lighting in the modular top assembly. This lighting is fully adjustable in both brightness and color temperature, allowing users to create optimal lighting conditions for their tasks, whether they require bright light for detailed work or softer lighting for reading. The lighting system is energy-efficient, ensuring long-lasting performance while maintaining low power consumption.

An alternate embodiment of the present invention includes a detachable monitor post with full rotating and tilting functions. The post is designed to support a wide range of monitor sizes, allowing users to position their monitors at ergonomic viewing angles. The post includes built-in cable management, ensuring that power and data cables are neatly routed and hidden from view, maintaining a clean and organized appearance.

An alternate embodiment of the present invention includes retractable anti-tip stabilizers that automatically extend when the height of the primary work surface exceeds a certain threshold. These stabilizers provide additional support during standing use, ensuring the trolley remains stable and secure, particularly when used in busy office environments where safety is a concern.

An alternate embodiment of the present invention includes a vertical, ventilated storage slot for securely storing a laptop. This slot allows users to connect their laptop to a docking station while using an auxiliary keyboard and monitor on the primary work surface. The ventilation ensures that the laptop remains cool during use, preventing overheating and prolonging the device's lifespan.

An alternate embodiment of the present invention includes non-marring casters equipped with an automatic braking system. When the trolley is stationary, the braking system automatically engages, providing additional stability during use. This feature is particularly useful when the trolley is used as a standing desk or when sensitive equipment is placed on the work surface.

An alternate embodiment of the present invention includes a roll-out storage drawer coated with non-slip material and equipped with raised edges. These features prevent items stored in the drawer from sliding around when the trolley is moved or the drawer is opened, ensuring that delicate or valuable items remain securely in place.

A preferred embodiment of the present invention includes an adjustable, non-rotating axle device for supporting modular tops in an office environment. The axle device features a vertically adjustable mechanism that allows users to smoothly raise or lower the modular top to suit their ergonomic preferences. The system includes a gas-spring lift for manual adjustments, offering controlled vertical movement with minimal effort. A locking system secures the top at the desired height, ensuring stability. The device also features a rotational coupling that allows the top to rotate around a vertical axis, offering users additional flexibility for positioning the work surface.

Another option for deploying the lift of the invention (shown in FIG. 4A or 4B) is to integrate the lift into a more conventional office desk, credenza, or workstation separate from the mobile trolley base unit. This would enable a smaller portion of a conventional desk, credenza, or workstation to have the above noted advantages of work surface adjustability using the adjustable axle, rotational coupling, and various work surfaces without requiring the entire desk, credenza, or workstation to be adjustable.

An alternate embodiment of the present invention includes a dual-chamber gas pressure balance mechanism integrated into the gas-spring lift system. This mechanism provides enhanced stability during height adjustments, minimizing wobbling and ensuring a secure and smooth transition between different work surface heights.

An alternate embodiment of the present invention includes a safety stop mechanism in the adjustable axle device, preventing the modular top from descending below a pre-set height. This feature ensures user safety, preventing the work surface from lowering to a level that could cause injury or damage to equipment.

An alternate embodiment of the present invention includes a rotational coupling with a damping mechanism, which reduces vibrations when rotating the modular top. This feature is particularly useful when delicate electronic devices, such as monitors or laptops, are placed on the surface, as it prevents excessive movement and ensures a stable work environment.

An alternate embodiment of the present invention includes a digital user interface that allows users to set and recall pre-set height positions. This feature provides added convenience by enabling users to quickly adjust the work surface to their preferred ergonomic settings without having to manually reposition the surface each time.

An alternate embodiment of the present invention includes a gas-spring lift system with a fixed lower limit, ensuring that the work surface does not descend below a user-safe height. This safety feature prevents the surface from lowering to an unintended level, protecting the user and preventing accidental injury.

A preferred embodiment of the present invention includes an adjustable, non-rotating axle device equipped with an electric lift system for smooth, controlled height adjustments. The electric lift is operated via a digital control panel, allowing users to precisely adjust the height of the modular top with the press of a button. A locking system secures the top at the desired height, ensuring stability during use. The device also features a rotational coupling for ergonomic adjustment of the work surface, and an integrated digital memory system that allows users to save and recall preferred height settings for quick adjustments.

An alternate embodiment of the present invention includes an electric lift system with a safety mechanism that prevents the work surface from descending below a pre-set height. This feature is designed to protect users from injury and ensure the safe operation of the trolley when adjusting the height of the work surface.

An alternate embodiment of the present invention includes a rotational coupling with a damping mechanism, designed to minimize vibrations when rotating the modular top. This feature ensures that electronic devices, such as monitors and laptops, remain stable and secure during operation, enhancing the overall user experience.

The transforming modular trolley integrates advanced functionality and modular design to enhance office productivity and ergonomics. Its roll-out storage drawer is engineered with a dual-purpose approach: offering expansive storage for office equipment like printers or filing trays while featuring integrated anti-tip mechanisms. These mechanisms ensure stability during operation, even when the drawer is extended. Additionally, the drawer is lined with a non-slip material and raised edges to securely hold stored items in place, minimizing movement or slippage during transit or usage.

The trolley includes a plurality of locking positions for its adjustable components, providing versatility and precision in customization. Notably, the first locking position and second locking position allow users to secure modular surfaces, such as the magnetically coupled tilt-able rod-equipped accessory surface, at specific angles or elevations. This adjustability ensures the ergonomic placement of items and prevents personal belongings from slipping, thanks to raised edges and bumpers on the riser panel.

A standout feature of the trolley is the detachable monitor post. This post is designed with built-in cable management, enabling users to conceal and organize cords effectively.

This feature contributes to a clutter-free workspace, accommodating the aesthetic and functional needs of modern office environments. The detachable monitor post further enhances the system's adaptability, offering both rotation and tilt functions. Integrated cable management within the post maintains a clean and organized appearance, even with a large curved monitor attached.

Together, these features make the transforming modular trolley an innovative and adaptable solution for diverse office environments, balancing form and function while addressing key ergonomic and organizational needs.

The present invention can include a version where any combination of work surfaces is coated with a non-slip material to provide stability for items placed upon it, preventing unintended movement during use. Additionally, these work surfaces feature a raised edge located proximal to a magnetically coupled tilt-able rod, designed specifically to further secure personal items such as phones, tablets, notebooks, or office supplies from slipping off the surface, particularly when the surface is tilted. This configuration is ideal for ensuring that items remain in place when users engage in activities like typing, drawing, or reading.

In this version, the primary work surface incorporates an alternate tilt mechanism with a locking feature that allows users to adjust the angle of the surface to suit various tasks. This locking mechanism provides enhanced comfort and ergonomics, enabling users to position the surface for optimal wrist and arm alignment during typing, or to set an ideal angle for writing, sketching, or viewing documents. By offering multiple angle adjustments, the work surface caters to different tasks, reducing strain and improving overall productivity.

An articulating accessory surface is also introduced in this version of the invention. This surface is equipped with a steel rod at its bottom edge, which is magnetically coupled to the primary work surface. The magnetic coupling provides a secure yet easily adjustable connection, allowing users to position the accessory surface as needed without requiring complex latches or manual tools. This magnetic attachment ensures smooth articulation while maintaining a firm hold, preventing unintended detachment during use. The strength of the magnetic connection allows the user to reposition the accessory surface quickly and efficiently for different uses or tasks.

The articulating accessory surface is further supported by a riser panel, which is attached to one of a plurality of slots located along the back of the accessory surface. These slots are designed to offer flexible adjustment options, enabling the user to set the riser panel in different positions to achieve various surface angles. This adjustability ensures that the accessory surface can be customized to meet the user's ergonomic needs or to accommodate various office tasks, such as holding a tablet, documents, or other materials in an optimal viewing position. Whether the user is sitting or standing, the riser panel can be repositioned to provide the right level of support.

At the bottom edge of the articulating accessory surface, there is a rod that serves as an additional barrier to hold items securely on the surface. This rod can be round, hexagonal, or shaped in another geometric configuration to provide both aesthetic flexibility and functional utility. The rod acts as a stopper, preventing items such as books, devices, or office supplies from sliding off the accessory surface, especially when the surface is tilted. This rod ensures that the user's materials remain safely positioned, even when adjusting the angle or when the surface is subjected to slight movements.

To further enhance the functionality and durability of the articulating accessory surface, a polyurethane bumper is integrated into the riser panel. This bumper is positioned at the bottom edge of the riser, where the riser makes contact with the primary work surface. The polyurethane material provides cushioning between the riser and the work surface, preventing wear and tear from repeated contact and reducing the potential for scratches or dents. The bumper also ensures smooth and stable articulation of the accessory surface, minimizing friction and noise during adjustments. This feature enhances the longevity of the work surface and the overall trolley, making it a durable solution for long-term use in an office environment.

The invention combines multiple innovative features that significantly improve the functionality, ergonomics, and durability of the transforming modular trolley. By integrating a magnetically coupled articulating accessory surface, flexible riser panel, and protective polyurethane bumpers, the invention offers users an adaptable workspace that is both user-friendly and highly practical. These features, along with the non-slip coating and raised edges, ensure that the trolley meets the dynamic needs of modern office environments, providing a seamless and secure experience for various work tasks.

The present invention, the transforming modular trolley for office use with an adjustable axle device, offers numerous advantages that address key challenges in modern work environments. Each advantage is designed to improve the overall functionality, ergonomics, and organization of office workspaces. Below is a detailed description of these advantages:

Ergonomic Flexibility—The invention provides a vertically adjustable axle mechanism that allows users to seamlessly transition between seated and standing work positions. This flexibility is critical in reducing the risk of musculoskeletal strain associated with prolonged sitting or standing. By providing smooth height adjustments, the trolley supports optimal ergonomic posture, reducing stress on the neck, back, and shoulders. The mechanism accommodates a wide range of heights, making it suitable for various body types and user preferences. The ability to alternate between seated and standing positions also promotes improved circulation and reduces fatigue, contributing to better long-term health outcomes for users who spend extended hours at their workstations.

Modular Customization—The modular top assembly of the transforming trolley is designed to accommodate multiple workspace configurations, offering users the ability to tailor the layout to their specific needs. The primary work surface is configured to hold one or more monitors, while dedicated surfaces for tablets, phones, personal items (such as cups), and office accessories ensure that essential tools are always within easy reach. The inclusion of a computer mouse surface adds to the convenience. The modular top can be offered in various sizes and designs, allowing users to optimize their workspace based on the size of their office, the nature of their work, and their personal preferences. This high degree of customization makes the trolley ideal for both home offices and professional settings where space and functionality are critical considerations.

Integrated Power Management-One of the most significant pain points in modern workspaces is the need to manage multiple electronic devices and their associated cables. The integrated power management system of the trolley solves this problem by including a power strip with multiple outlets, wireless charging pads for cordless device charging, and thoughtfully designed cable management paths. These features ensure that power cables, charging cords, and other electronic accessories are neatly organized and easily accessible, preventing the clutter that typically accumulates in traditional workstations. The wireless charging pads allow users to keep their devices powered without the need for additional cables, contributing to a cleaner and more streamlined workspace.

Compact Storage and Mobility—The transforming modular trolley is designed to maximize space efficiency. The modular top assembly can be rotated into a compact position, allowing the entire trolley to be stored easily when not in use. This feature is especially useful in smaller office environments or shared workspaces where flexibility and portability are essential. Additionally, the trolley is mounted on non-marring casters that allow for smooth mobility across different floor surfaces, including hardwood, tile, and carpet. These casters enable users to reposition the trolley effortlessly, and the inclusion of a two-way drawer slide allows the roll-out storage drawer to be opened from either side of the trolley. This feature enhances its versatility, making it easy to access storage even when space is limited.

Stable and Safe Design-Safety and stability are critical considerations in any office environment, especially when using height-adjustable workstations. The trolley incorporates retractable anti-tip stabilizers that automatically extend when the height of the primary work surface exceeds a predefined threshold. This feature ensures that the trolley remains stable and secure, even when the work surface is raised to standing height or if equipping the trolley with large or multiple monitors. The stability of the trolley prevents tipping or wobbling, protecting both the user and any valuable equipment placed on the trolley. In addition, the casters are equipped with an automatic braking system that engages when the trolley is stationary, providing further stability and preventing accidental movement during use.

Enhanced Storage Options—The invention provides a variety of storage solutions designed to keep workspaces organized and clutter-free. The ventilated storage compartment is ideal for housing power supplies, laptops, docking stations, or other office supplies, ensuring that essential items are both stored securely and properly ventilated to prevent overheating. The roll-out storage drawer is designed with integrated anti-tip mechanisms and is spacious enough to store small office equipment such as printers, filing trays, and other personal items. Customizable dividers in the drawer provide additional organization, allowing users to create compartments that suit their specific needs. The trolley also includes a vertical, ventilated storage slot for laptops, enabling the user to connect a laptop to a docking station while using an auxiliary keyboard or other peripherals on the primary work surface.

Improved User Experience—To enhance the overall user experience, the transforming modular trolley includes several features that promote comfort and convenience. Integrated LED task lighting is built into the modular top assembly, providing users with adjustable brightness and color temperature options. This lighting ensures that users can work comfortably in any lighting condition, reducing eye strain and improving focus. The detachable monitor post allows for easy adjustment of monitors to the ideal viewing angle, reducing neck strain and improving ergonomics. This post also features built-in cable management, keeping monitor cords neatly organized and out of sight, further contributing to a clean and efficient workspace.

Safety and Stability in Height Adjustments—The adjustable axle device within the trolley is designed for stability and safety during height adjustments. The gas-spring lift system is equipped with a dual-chamber gas pressure balance mechanism that provides smooth and controlled vertical adjustments with minimal effort. This system minimizes wobbling and ensures that the work surface remains stable, even when adjusting the height frequently. Safety stop mechanisms prevent the work surface from descending below a certain height, protecting the user from injury and preventing damage to the equipment. For added convenience, an electric lift system with a digital user interface allows users to set and recall pre-set height positions, making it easy to adjust the work surface to previously saved settings without repeated manual adjustments.

Customizable Height and Orientation—In addition to vertical height adjustments, the trolley's adjustable axle device includes a rotational coupling that enables the modular tops to rotate around a vertical axis. This allows users to orient the work surface in a way that suits their workflow and ergonomic preferences. The rotational coupling includes a damping mechanism that reduces vibrations during rotation, ensuring that any connected devices (such as monitors or laptops) remain stable. The ability to customize both the height and orientation of the work surface provides users with a highly adaptable workspace, improving productivity and comfort.

Sustainable and Practical Design—The transforming modular trolley is designed with sustainability in mind. By consolidating multiple office functions—such as height adjustability, power management, and storage—into a single, compact unit, the trolley reduces the need for multiple separate pieces of office furniture. This consolidation results in a more efficient use of materials and space. The modular design also allows users to adapt the trolley over time, extending its functional lifespan and reducing the need for frequent replacements. The use of durable, eco-friendly materials in the construction of the trolley and its storage compartments further contributes to its sustainability, making it an environmentally conscious choice for modern offices.

The advantages of the present invention highlight how the transforming modular trolley offers a comprehensive solution to the challenges of modern office workspaces. By combining ergonomic flexibility, customizable modular design, integrated power management, and enhanced storage options, this invention provides a practical and user-friendly workspace that enhances productivity and comfort while maintaining safety and sustainability.

The invention has been described by way of examples only. Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the claims.

Although the invention has been explained in relation to various embodiments, it is to be understood that many other possible modifications and variations can be made without departing from the spirit and scope of the invention.

The invention claimed is:

1. An adjustable, non-rotating axle device for supporting one or more modular tops, comprising:

a vertically adjustable axle mechanism including a non-rotating spindle configured to provide height adjustment for ergonomic positioning during seated or standing work;

a lift assembly coupled to said non-rotating spindle and configured to move vertically through one of a gas-spring lift system or an electric lift system, said lift assembly being independent of any rotational movement of said non-rotating spindle;

a rotational coupling disposed at an upper end of said non-rotating spindle and configured to mechanically couple at least one modular top to said non-rotating spindle such that said modular top can rotate about said non-rotating spindle independently of a rotation or lack thereof of said non-rotating spindle, and can be locked in a plurality of angular positions; and a locking system configured to secure said modular top at a selected height and a rotational position;

wherein said adjustable, non-rotating axle device is adapted to be mounted to another piece of furniture to provide customizable ergonomic and transformable workspace configurations.

2. The adjustable, non-rotating axle device of claim 1, wherein said gas-spring lift system comprises a dual-chamber gas pressure balance mechanism configured to provide a smooth, a stable, and a wobble-free vertical adjustment.

3. The adjustable, non-rotating axle device of claim 1, wherein said lift assembly comprises an electric linear actuator configured for powered vertical movement of said modular top.

4. The adjustable, non-rotating axle device of claim 3, wherein said electric actuator includes a digital control interface having a memory function enabling a user to store and recall pre-set height positions.

5. The adjustable, non-rotating axle device of claim 1, wherein said rotational coupling includes a damping mechanism configured to reduce vibrations and provide smooth rotational movement of said modular top.

6. The adjustable, non-rotating axle device of claim 1, wherein said rotational coupling includes a multi-position detent or a friction lock for securing at least one of said modular tops in one of said plurality of angular positions.

7. The adjustable, non-rotating axle device of claim 1, further comprising a safety stop mechanism configured to prevent said modular top from descending below a predetermined minimum height.

8. The adjustable, non-rotating axle device of claim 1, wherein said lift assembly includes a fixed lower limit preventing downward travel of said modular top below a user-safe height.

9. The adjustable, non-rotating axle device of claim 1, wherein said rotational coupling is configured to support a plurality of modular tops, each capable of rotating independently of one another about said non-rotating spindle.

10. The adjustable, non-rotating axle device of claim 1, wherein said rotational coupling comprises a removable or interchangeable mounting interface allowing for substitution of different modular tops.

11. The adjustable, non-rotating axle device of claim 1, wherein said non-rotating spindle and said rotational coupling are provided as a modular subassembly configured for said modular tops to rotate independently from each other and to be incorporated into either an existing or newly designed desk, workstation, or other furniture structure.

* * * * *